US005281116A

United States Patent [19]

Gwin

[11] Patent Number: 5,281,116

[45] Date of Patent: Jan. 25, 1994

[54] SUPERCHARGER VENT

[75] Inventor: Darwin L. Gwin, Marshall, Mich.

[73] Assignee: Eaton Corporation, Cleveland, Ohio

[21] Appl. No.: 10,722

[22] Filed: Jan. 29, 1993

[51] Int. Cl.[5] ..... F04C 18/16; F04C 29/02

[52] U.S. Cl. ..... 418/94; 418/201.1

[58] Field of Search ..... 418/94, 191, 201.1; 123/559.1, 41.86

[56] References Cited

U.S. PATENT DOCUMENTS

| | | | |
|---|---|---|---|
| 2,287,716 | 6/1942 | Whitfield . | |
| 2,480,818 | 8/1949 | Whitfield . | |
| 3,382,018 | 5/1968 | Brkich . | |
| 3,875,916 | 4/1975 | Patton | 123/41.86 |
| 4,402,493 | 9/1983 | Tsuge | 267/64.21 |
| 4,579,092 | 4/1986 | Kandler | 123/41.86 |
| 4,714,418 | 12/1987 | Matsubara et al. | 418/201 |
| 4,886,019 | 12/1989 | Davis et al. | 123/41.86 |
| 4,924,839 | 5/1990 | Mueller et al. | 123/559.1 |

FOREIGN PATENT DOCUMENTS

| | | | |
|---|---|---|---|
| 620267 | 10/1935 | Fed. Rep. of Germany | 123/41.86 |
| 929914 | 7/1947 | France | 123/41.86 |
| 444310 | 1/1949 | Italy | 418/94 |
| 222583 | 11/1985 | Japan | 418/201.1 |

*Primary Examiner*—Michael Koczo

*Attorney, Agent, or Firm*—P. S. Rulon

[57] ABSTRACT

An intake manifold (18) of an engine (10) includes a Roots-type supercharger (26) having rotors (28,29) driven by timing gears (72,74) disposed in a gear chamber (62) having a self contained oil supply and vent 98. The vent is formed in an input drive shaft (52) of the supercharger. The vent embodiments of FIGS. 2-4 include a radially extending passage opening into gear chamber (62) and effective to sling oil mist back into the gear chamber.

10 Claims, 2 Drawing Sheets

FIG 1
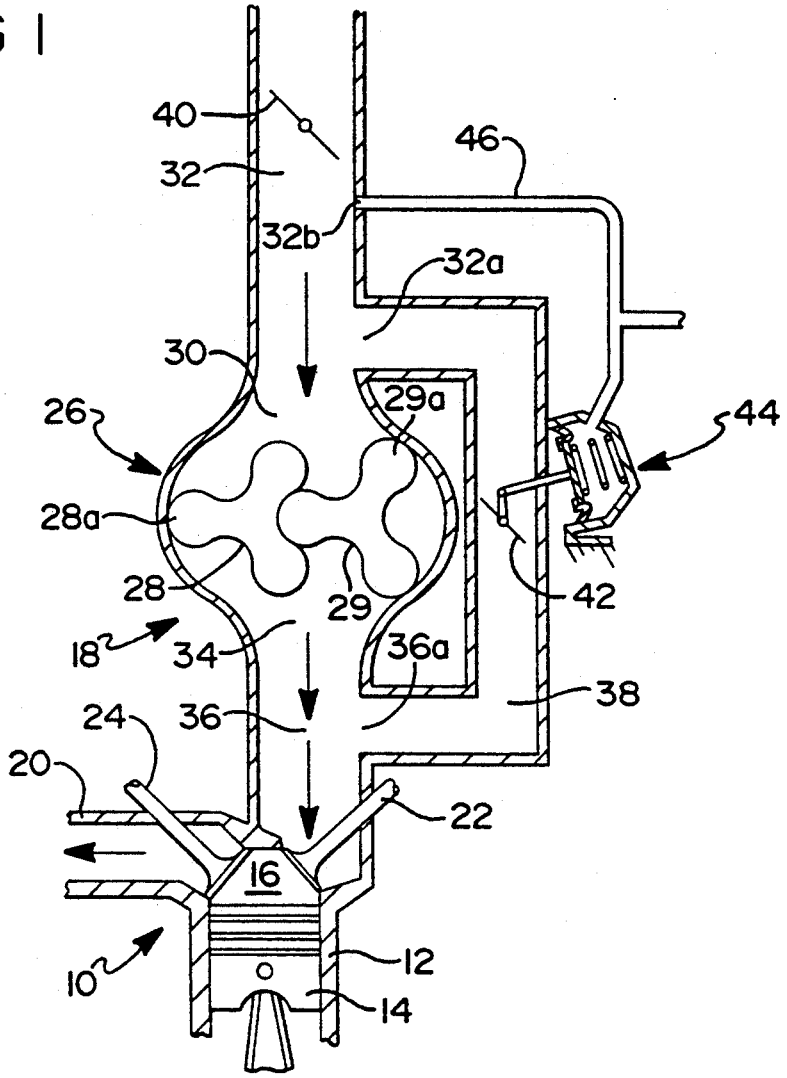
FIG 4
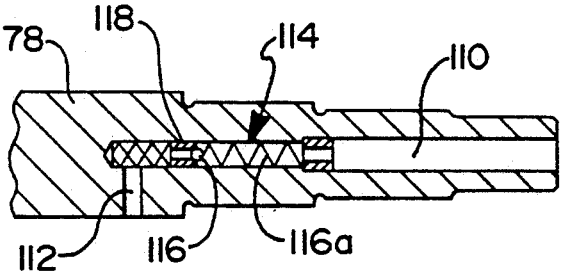
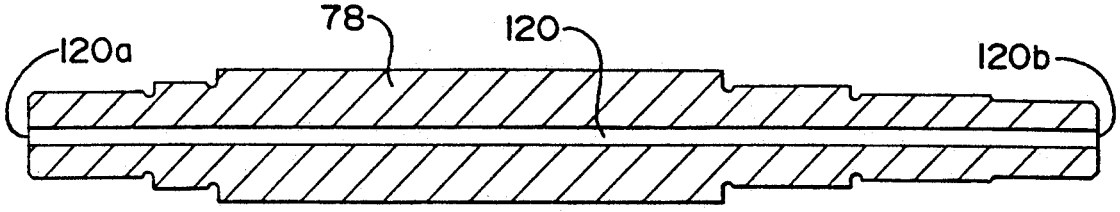
FIG 5

108
104
106
78
26
86
80
58
62
71
60
48
72
62a
54
84
84a
92
94
74
56
56b
68
66
66
96
68
70
56c
56a
64
29
50
28
52
98
102
102a
100
76
88
90
100a
76a
82
80

SUPERCHARGER VENT

FIELD OF THE INVENTION

This invention relates to rotary compressors or blowers, particularly to blowers of the backflow type. More specifically, the present invention relates to a vent for a gear chamber of a Roots-type blower employed as a supercharger for an internal combustion engine.

BACKGROUND OF THE INVENTION

Rotary blowers having rotors driven by timing gears disposed in a gear chamber partially filled with lubricating oil are well known in the art as may be seen by reference to U.S. Pat. Nos. 4,924,839 and 4,714,418. These patents are incorporated herein by reference. The gear chamber in U.S. Pat. No. 4,924,839 has a self contained oil supply for lubricating the timing gears and bearings open to the chamber in response to rotation of the gears. The timing gears, which are partially submerged in the oil, sling the oil about the chamber to effect the lubrication. Such slinging causes a rather fine air oil mist in the chamber. Attempts to employ conventional vents for the chamber to relieve pressure buildup in the chamber, as in U.S. Pat. No. 4,714,418, have caused loss of oil due to the fine oil mist flowing through the vent.

SUMMARY OF THE INVENTION

An object of this invention is to provide a gear chamber vent of a rotary blower which minimizes loss of oil.

According to a feature of this invention, a rotary blower comprises a housing defining a rotor chamber and a gear chamber separated by a wall. First and second meshed lobed rotors are each disposed for rotation about an axis thereof in the rotor chamber for transferring a gaseous fluid from a housing inlet to a housing outlet. First and second rotor shafts are respectively affixed to the first and second rotors and extend along the axes thereof into the gear chamber through openings in the wall. First and second meshed timing gears are respectively affixed to portions of the first and second rotor shafts in the gear chamber. An input drive shaft extends along an axis thereof from an end exterior of the housing through an input drive opening defined by the housing and into the gear chamber for rotatably driving the timing gears. A lubricating oil is disposed in the gear chamber to a level wherein rotation of the gears slings the oil. Bearing means rotatably support each of the shafts in the opening associated therewith. Dynamic seal means, associated with each of the openings and the shaft extending therethrough, sealingly separate the chambers from each other and the gear chamber from the housing exterior.

The blower is characterized by vent passage means in the input drive shaft for venting the gear chamber to the exterior. The passage means has one end thereof opening into the gear chamber, an opposite end thereof opening into the exterior of the housing, and an elongated passage intercommunicating the ends.

BRIEF DESCRIPTION OF THE DRAWINGS

The blower and vent of the present invention is shown in the accompanying drawings in which:

FIG. 1 schematically illustrates an intake manifold assembly having a positive displacement, backflow blower or supercharger therein for boosting pressure to an internal combustion engine;

FIG. 2 is a partial horizontal sectional view of the supercharger; and

FIGS. 3-5 are sectional views of alternative embodiments of a vent shown in FIG. 2.

DETAILED DESCRIPTION OF THE DRAWINGS

Figures 2, 3:
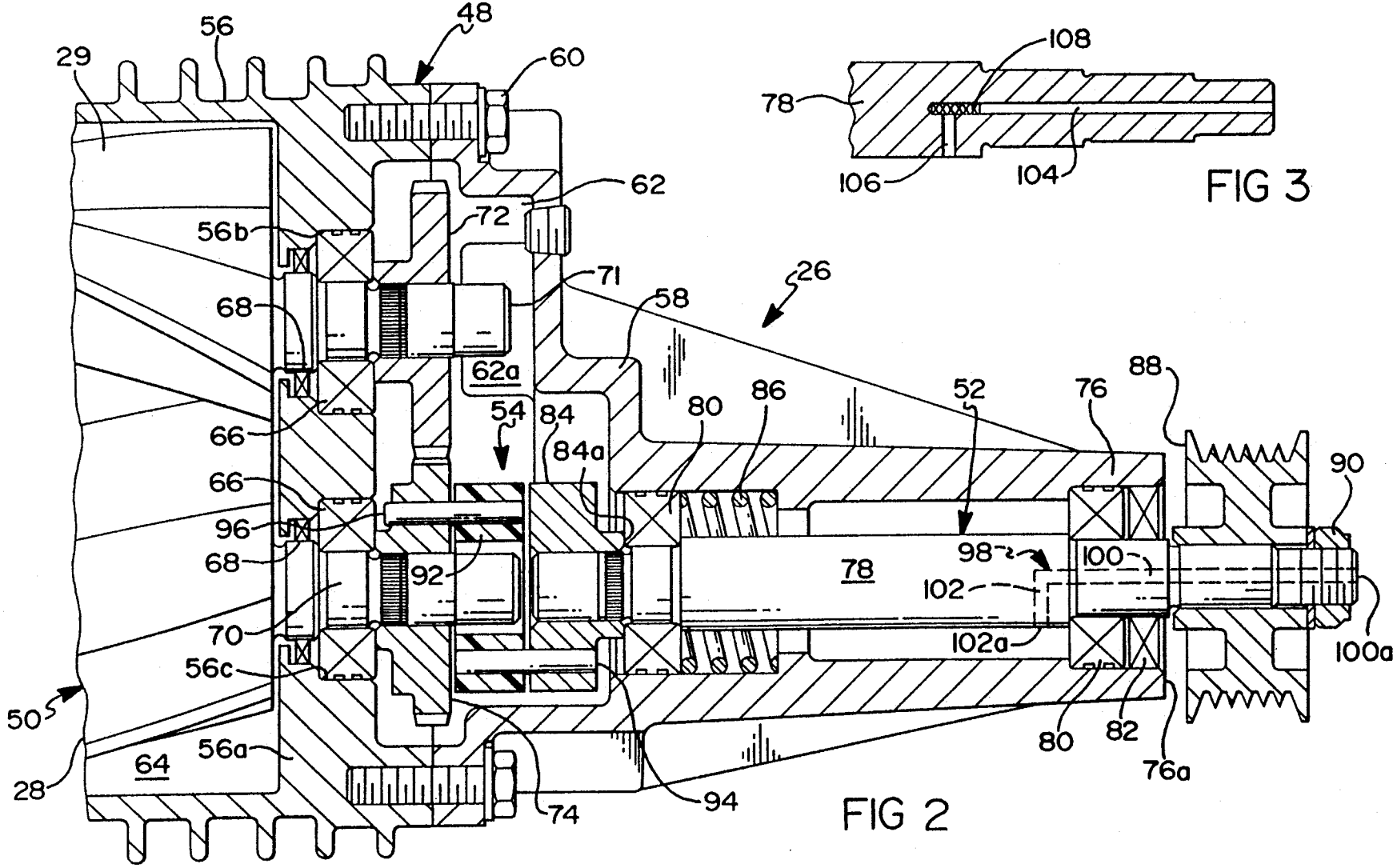

Referring first to FIG. 1, therein is schematically illustrated a portion of an internal combustion engine 10 which is preferably of the periodic combustion type such as the Otto or Diesel cycle type. The engine includes a plurality of cylinders 12 and a reciprocating piston 14 disposed within each cylinder to define an expandable combustion chamber 16. The engine includes intake and exhaust manifold assemblies 18,20 for respectively directing combustion air to-and-from the combustion chambers via intake and exhaust valves 22,24.

The intake manifold assembly 18 includes a positive displacement blower 26 of the backflow or Roots-type having a pair of rotors 28,29 with meshed lobes **28*a*,29*a***. The rotors may be mechanically driven by engine crankshaft torque transmitted thereto in known manner via an unshown drive belt. The mechanical drive rotates the blower rotors at a fixed ratio relative to crankshaft speed and such that the blower displacement is greater than the engine displacement, thereby boosting or supercharging the air going to the engine combustion chambers to increase engine power.

The supercharger includes an inlet port 30 receiving an air or air-fuel mixture charge from an inlet duct or passage 32 and a discharge or outlet port 34 directing the charge to the intake valves 22 via a discharge duct or passage 36. The intake and discharge ducts are intercommunicated via a bypass duct or passage 38 connected at openings **32*a*,36*a* in the intake and discharge ducts 32,36, respectively. If the engine 10 is of the Otto cycle type, a throttle valve 40 preferably controls air or air-fuel mixture flow into intake duct 32** from a source, such as ambient or atmospheric air, in a well known manner.

Disposed within the bypass duct is a bypass valve 42 which is moved between open and closed positions by an actuator assembly 44 responsive to pressure in inlet duct 32 via a line 46 and therefore operative to control supercharging pressure in duct 36 as a function of engine power demand. When bypass valve 42 is in the fully open position, the air pressure in discharge duct 36 is relatively low or a minimum relative to the air pressure in intake duct 32. When the valve is fully closed, the air in the discharge duct is relatively high.

Looking now at FIG. 2, therein is shown a portion of blower 26 in detail. The shown portion includes a housing assembly 48, a rotor assembly, and input drive assembly 52, and a coupling 54. The coupling may include a torsion damping assembly, such as for example is disclosed in U.S. Pat. No. 4,844,044 and incorporated herein by reference. The housing assembly includes a main housing section 56 and an input drive housing section 58 secured together by a plurality of bolts 60 and defining therebetween, with an end wall portion **56*a*, a gear chamber 62. The main housing section 56 defines a rotor chamber 64 separated from the gear chamber by the wall portion 56*a* which includes stepped through bores 56*b*,56*c* for supporting anti-friction bearings 66 and dynamic seals 68. The main housing section also defines the inlet and outlet ports 30,34 and a second unshown end wall for closing the left end of rotor chamber 64 and supporting bearing similar to bearing 66**. The inlet port may be of the type shown in U.S. Pat. No. 5,078,583 and incorporated herein by reference.

The rotor assembly 50 includes the rotors 28,29, shafts 70,71 fixed to the rotors and supported at both ends by bearings such as bearings 66, and meshed timing gears 72,74 pressed on the right ends of shafts 70,71 and operative to prevent contact of meshing rotor lobes **28*a*,29*a*. Rotors 28,29, like housing assembly 48, are preferably formed of a light-weight material, such as aluminum alloy. The rotors may include any number of lobes, herein each rotor includes three lobes 28*a*,29*a*. The lobes may be straight, as shown in FIG. 1, or helical, as shown in FIG. 2**. A more detailed description of the main housing section and rotor assembly may be found in U.S. Pat. No. 4,638,570 which is incorporated herein by reference.

Input drive housing section 58 includes a tubular portion 76 opening at its left end into gear chamber 62 and opening at its right end **76*a* to the exterior of the housing assembly. The input drive assembly includes an input drive shaft 78 extending through both openings and supported in the tubular portion in axial alignment with the axis of shaft 70 by anti-friction bearings 80. A dynamic seal 82 seals the space between tubular portion 76 at right end 76*a* and the outer surface of shaft 78. An annular member 84 is pressed on the left end of shaft 78 and a spring 86 leftwardly biases the leftwardly disposed bearing 80 against a shoulder 84*a* of annular member 84 to prevent bearing flutter. A pulley 88 is secured to the right exterior end of shaft 78 by an unshown key and a nut 90**. The pulley is driven by the previously mentioned and unshown belt which transmits engine torque.

Coupling 54 includes an annular member 92, a set of three axially extending pins 94 drivingly interconnecting members 88,92, and a set of three axially extending pins 96 drivingly interconnecting member 92 and timing gear 74.

The sectional view of FIG. 2 is looking vertically downward toward a bottom **62*a* of gear chamber 62. The gear chamber provides a reservoir for a self contained lubricating oil supply for gears 72,74 and bearings 66,80. The oil level in the gear chamber is sufficient for the teeth of gears 72,74** to sling oil about the chamber to effect the lubrication. Such slinging causes a rather fine air-oil mist in the chamber.

The gear chamber as thus far described is sealed from rotor chamber 64 by seals 68 and from the exterior of the housing assembly by seal 82. Hence, during blower operation, gear chamber 62 has been subject to pressure buildup due to temperature rise therein and possibly due to pressurized air in chamber 64 being forced past seals 68. Attempts to cost effectively prevent or relieve the pressure via known oil separating vents without misting the oil through the vent have been unsuccessful due to the fineness of the air-oil mist in the chamber.

In FIG. 2 gear chamber is vented to the exterior of the blower housing assembly via an elongated vent 98 formed in input drive shaft 78 and shown in phantom lines. Vent 98 includes drilled passages 100 and 102. Passage 100 extends along and concentric to the axis of shaft 78 with one end **100*a* thereof opening to the exterior. Passage 102 extends radially with respect to the axis, intersects the blind end of passage 100, and has one end 102*a* in the outer circumferential surface of shaft 78** opening into the gear chamber. The radially extending portion of passage functions as a centrifuge which effectively slings oil in the air-oil mist back into the gear chamber during shaft rotation.

In the sectioned, partially shown view of shaft 78 in FIG. 3 the vent includes passages 104,106 respectively analogous to passages 100,102 with a filter 108 disposed in passage 104 to prevent entrance of foreign matter into the gear chamber. The filter is preferably, but not necessarily, of the sintered metal type.

In another vent embodiment of FIG. 4, shaft 78 includes passages 110,112 respectively analogous to passages 104,106 and further including a check valve assembly 114 disposed in passage 110. A primary purpose of the check valve assembly is to prevent loss of gear chamber oil when the blower drive is tilted down while the blower is inoperative. The check valve assembly includes a spring 112 biasing a ball 116 against a valve seat defined by one end of a tubular member 118 with a force that readily yields to rather a small pressure differential across the ball, for example, 1 or 2 pounds per square inch.

In yet another embodiment of the vent, as shown in FIG. 5, the vent includes a single passage 120 concentric to the shaft axis and extending the full length thereof with opposite ends **120*a*, 120*b* respectively opening into the gear chamber and the exterior. The extensive length of passage 120 mitigates migration of the oil mist to opening 120*b*, reduces need for a filter, and negates need for the check valve assembly since end 120*a* will be above the oil level when the blower drive end is tilted down. In the event the oil mist migrates along the full length of passage 120 the left end of shaft may be shortened and annular member 84 may be modified to provide a radially extending passage analogous to passage 102**.

Several embodiments of the invention have been disclosed herein for illustrative purposes. Many variations and modifications of the disclosed embodiments are believed to be within the spirit of the invention. The following claims are intended to cover inventive portions of the disclosed embodiments and variations and modifications believed to be within the spirit of the inventive portions.

What is claimed is:

1. A rotary blower comprising:

a housing defining a rotor chamber and a gear chamber separated by a wall;

first and second meshed lobe rotors each disposed for rotation about an axis thereof in the rotor chamber for transferring a gaseous fluid from a housing inlet to a housing outlet;

first and second rotor shafts respectively affixed to and extending from the first and second rotors along the axis thereof and into the gear chamber through openings in the wall;

first and second meshed timing gears respectively affixed to portions of the first and second rotor shafts in the gear chamber;

an input drive shaft extending along an axis thereof from an end exterior of the housing through an input drive opening defined by the housing and into the gear chamber for rotatably driving the timing gears;

a lubricating oil disposed in the gear chamber to a level wherein rotation of the gears slings the oil;

bearing means rotatably supporting each of the shafts in the opening associated therewith;

dynamic seal means, associated with each of the openings and the shaft extending therethrough, for sealingly separating the chambers from each other and the gear chamber from the housing exterior; characterized by:

vent passage means in the input drive shaft for venting the gear chamber to the exterior for preventing pressure build up in the chamber, the passage means having one end thereof opening into the gear chamber, an opposite end thereof opening into the exterior, an elongated passage intercommunicating the ends, and a portion of the elongated passage leading to the one end extends radially with respect to the axis of the input drive shaft.

2. The rotary blower of claim 1, including:

a filter disposed in the passage means.

3. The rotary blower of claim 2, wherein:

the filter is of a sintered metal type.

4. The rotary blower of claim 1, wherein:

the one end of the passage means opens in a radially outwardly facing surface of the input drive shaft.

5. The rotary blower of claim 1, including:

a valving member biased to a position closing the passage means by a force of a resilient means and movable to an open position counter to the force in response to a predetermined positive pressure in the gear chamber.

6. The rotary blower of claim 5, wherein:

the one end of the passage means opens in a radially outwardly facing surface of the input drive shaft.

7. The rotary blower of claim 6, wherein:

the elongated passage includes another portion extending along the input drive shaft axis from the opposite end of the elongated passage to a position intersecting the radially extending portion of the elongated passage.

8. The rotary blower of claim 7, wherein:

the valving member is disposed in the other portion of the elongated passage.

9. The rotary blower of claim 8, including:

a filter disposed in the other portion of the elongated passage.

10. The rotary blower of claim 9, wherein:

the filter is of a sintered metal type.

* * * * *